US009939777B2

(12) United States Patent
Kamiya et al.

(10) Patent No.: US 9,939,777 B2
(45) Date of Patent: Apr. 10, 2018

(54) ATTACHMENT STRUCTURE FOR ATTACHABLE BODY AND IMAGE FORMING APPARATUS

(71) Applicant: FUJI XEROX CO., LTD., Tokyo (JP)

(72) Inventors: Shogo Kamiya, Kanagawa (JP); Kenji Kanai, Kanagawa (JP); Yasunori Fujimoto, Kanagawa (JP); Masakatsu Eda, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/447,260

(22) Filed: Mar. 2, 2017

(65) Prior Publication Data

US 2018/0059614 A1 Mar. 1, 2018

(30) Foreign Application Priority Data

Aug. 30, 2016 (JP) ..... 2016-168358

(51) Int. Cl.
*G03G 15/20* (2006.01)
*G03G 21/16* (2006.01)

(52) U.S. Cl.
CPC ..... *G03G 21/1652* (2013.01); *G03G 21/1685* (2013.01)

(58) Field of Classification Search
CPC ..... G03G 15/2032; G03G 21/1647; G03G 21/1652; G03G 21/1685; G03G 21/1865
USPC ..... 399/90, 122
See application file for complete search history.

(56) References Cited

U.S. PATENT DOCUMENTS 6,819,895 B2 * 11/2004 Suzuki ..... G03G 15/2035 399/122
7,164,878 B2 * 1/2007 Yamanaka ..... G03G 15/2032 399/122
8,737,878 B2 * 5/2014 Yamaguchi et al. ..... G03G 21/1685 399/122
8,750,756 B2 * 6/2014 Tanda ..... G03G 15/2032 399/122

FOREIGN PATENT DOCUMENTS

JP 2009-229929 A 10/2009

* cited by examiner

*Primary Examiner* — William J Royer
(74) *Attorney, Agent, or Firm* — Sughrue Mion, PLLC

(57) ABSTRACT

An attachment structure for an attachable body includes an attachable body, a connecting unit, a first regulating device, and a second regulating device. The attachable body is attachable to an apparatus body and has a leading end and a trailing end in an attachment direction in which the attachable body is attached to the apparatus body. The connecting unit is provided on a leading end side of the attachable body in the attachment direction. The connecting unit is connected to the apparatus body. The first regulating device regulates a movement of the attachable body in the attachment direction from a trailing end side. The second regulating device is provided at a position closer to the connecting unit than to the first regulating device in a perpendicular direction perpendicular to the attachment direction. The second regulating device regulates the movement of the attachable body.

9 Claims, 10 Drawing Sheets

ATTACHMENT STRUCTURE FOR ATTACHABLE BODY AND IMAGE FORMING APPARATUS

CROSS-REFERENCE TO RELATED APPLICATIONS

This application is based on and claims priority under 35 USC 119 from Japanese Patent Application No. 2016-168358 filed Aug. 30, 2016.

BACKGROUND

Technical Field

The present invention relates to an attachment structure for an attachable body and an image forming apparatus.

SUMMARY

According to an aspect of the present invention, an attachment structure for an attachable body includes an attachable body, a connecting unit, a first regulating device, and a second regulating device. The attachable body is attachable to an apparatus body and has a leading end and a trailing end in an attachment direction in which the attachable body is attached to the apparatus body. The connecting unit is provided on a leading end side of the attachable body in the attachment direction. The connecting unit is connected to the apparatus body. The first regulating device regulates a movement of the attachable body in the attachment direction from a trailing end side. The second regulating device is provided at a position closer to the connecting unit than to the first regulating device in a perpendicular direction perpendicular to the attachment direction. The second regulating device regulates the movement of the attachable body.

BRIEF DESCRIPTION OF THE DRAWINGS

An exemplary embodiment of the present invention will be described in detail based on the following figures, wherein.

DETAILED DESCRIPTION

An Overall Structure of an Image Forming Apparatus

Figure 1:
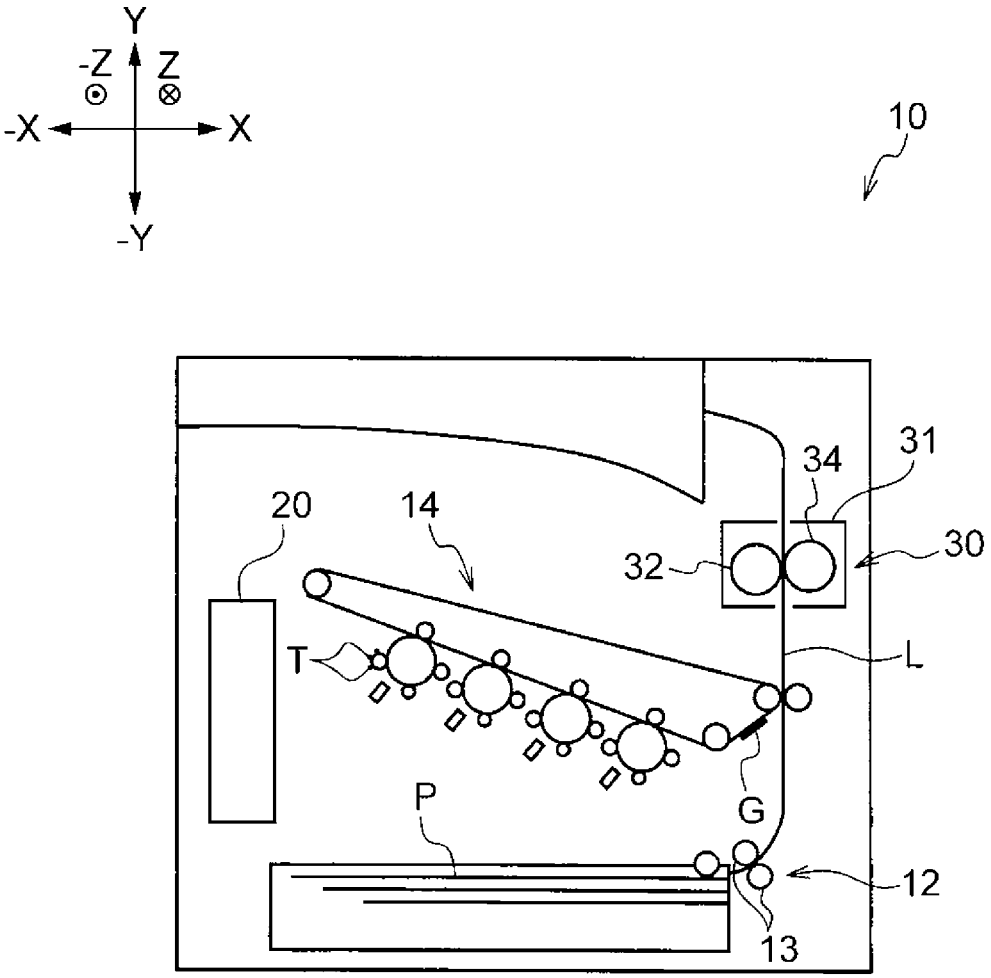
FIG. 1 is a structural view (front view) of an image forming apparatus according to an exemplary embodiment.

As illustrated in FIG. 1, an image forming apparatus 10 according to an exemplary embodiment includes a transport section 12, an image forming section 14, a fixing device 30, and a controller 20. The transport section 12 includes a transport roller pair 13 that transports sheets P. The image forming section 14 forms toner images G with toner T on the sheets P transported by the transport section 12. The fixing device 30 heats the toner images G so as to fix the toner images G onto the sheets P. Here, the fixing device 30 is an example of an attachable body.

The image forming section 14 performs charging, light exposure, developing, and transfer steps which are steps in a known electrophotographic method. Furthermore, the controller 20 controls components of the image forming apparatus 10 other than the controller 20.

It is noted that, in the following description, when the image forming apparatus 10 is seen from the front as illustrated in FIG. 1, the apparatus height direction, the apparatus width direction, and the apparatus depth direction are respectively referred to as the Y direction, the X direction, and the Z direction. Furthermore, in the case where it is required to distinguish between one side and another side in the X direction, the Y direction, and the Z direction, the upper side is the Y side, the lower side is the −Y side, the right side is the X side, the left side is the −X side, the rear side is the Z side, and the front side is the −Z side when the image forming apparatus 10 is seen from the front.

Image Forming Operation

Next, an image forming operation according to the present exemplary embodiment is described with reference to FIG. 1.

Upon reception of image data from an external device (not illustrated), the controller 20 causes the components of the image forming apparatus 10 other than the controller 20 to operate. Specifically, the controller 20 causes the transport section 12 to transport the sheets P, causes the image forming section 14 to form the toner images G, and causes the fixing device 30 to fix the toner images G on the sheets P. The sheets P onto which the toner images G have been fixed are output to the outside of the image forming apparatus 10. Thus, the image forming operation has been performed.

Configurations of Parts

Figure 2:
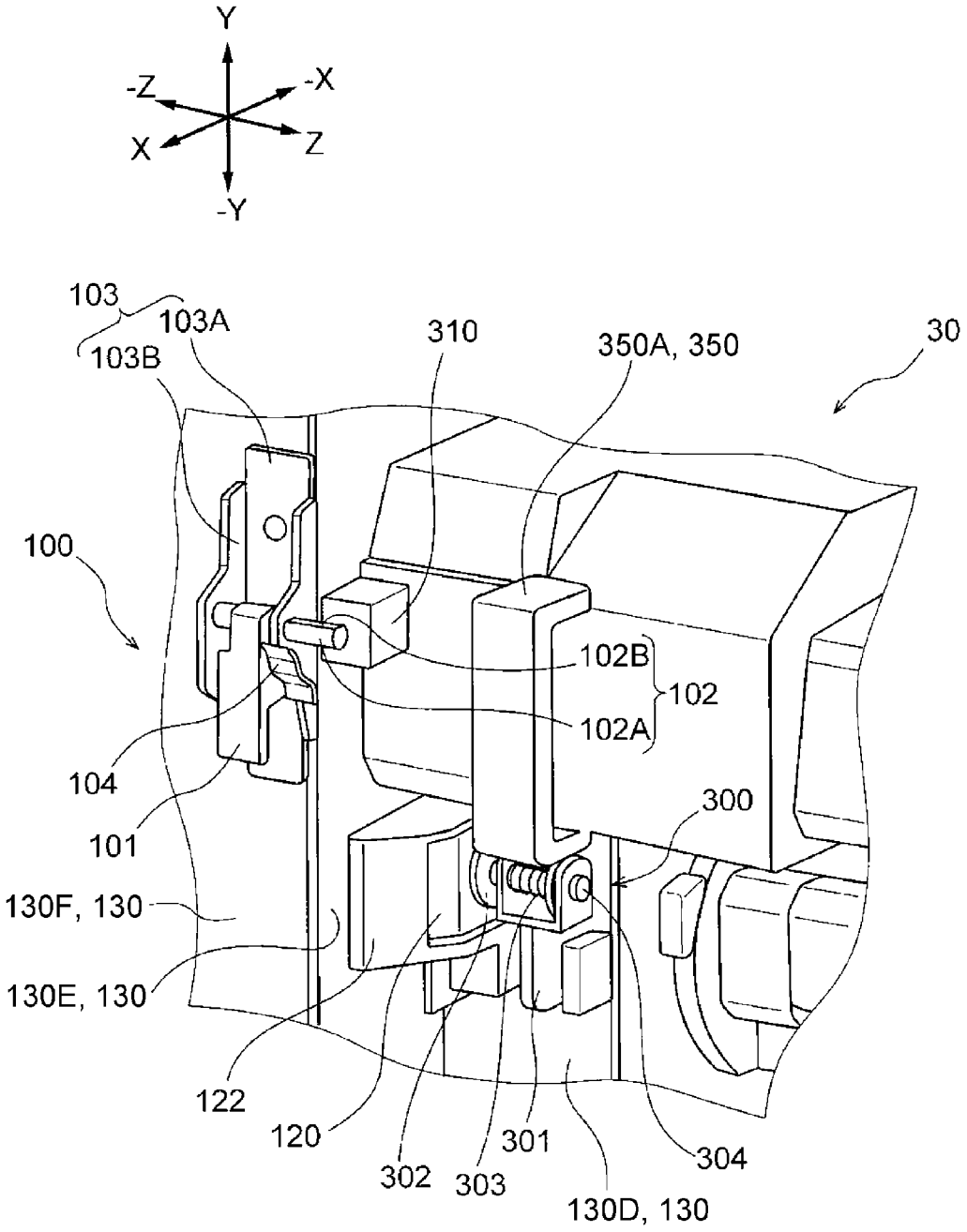
FIG. 2 is a perspective view of a firmly securing device and a temporarily securing device of the image forming apparatus according to the present exemplary embodiment.
Figure 3A:
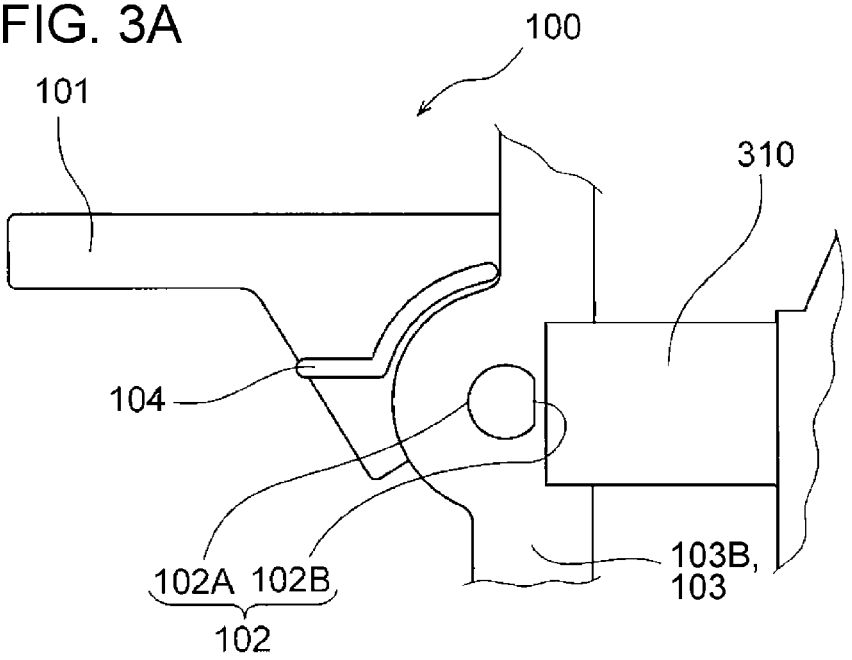
FIGS. 3A and 3B are side views illustrating operation of the firmly securing device.
Figure 3B:
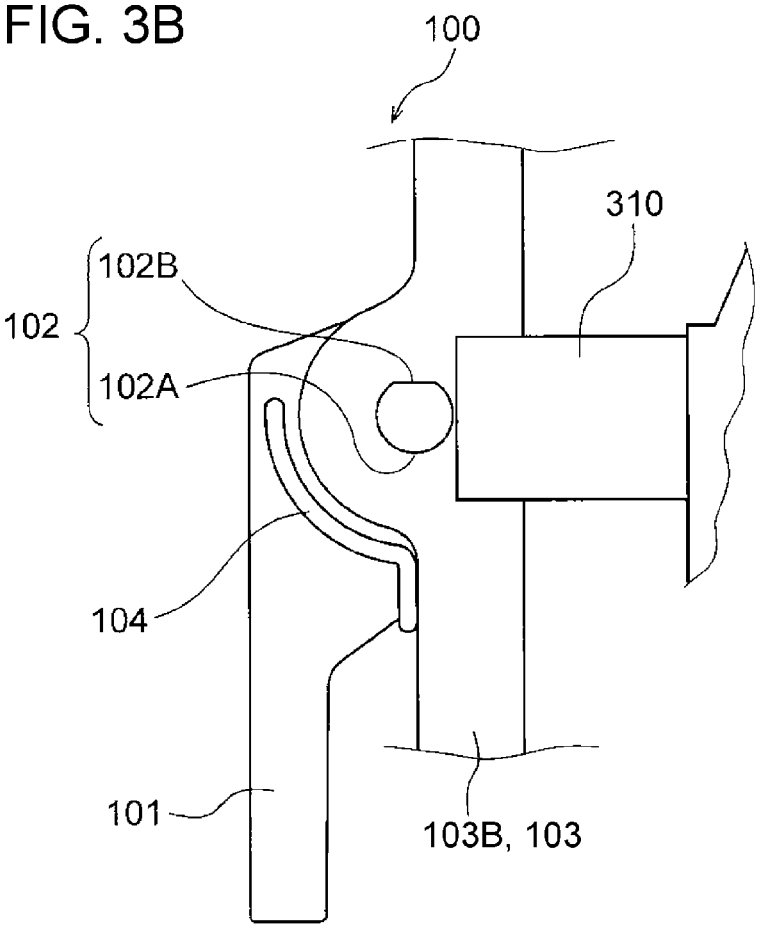
Figure 4:
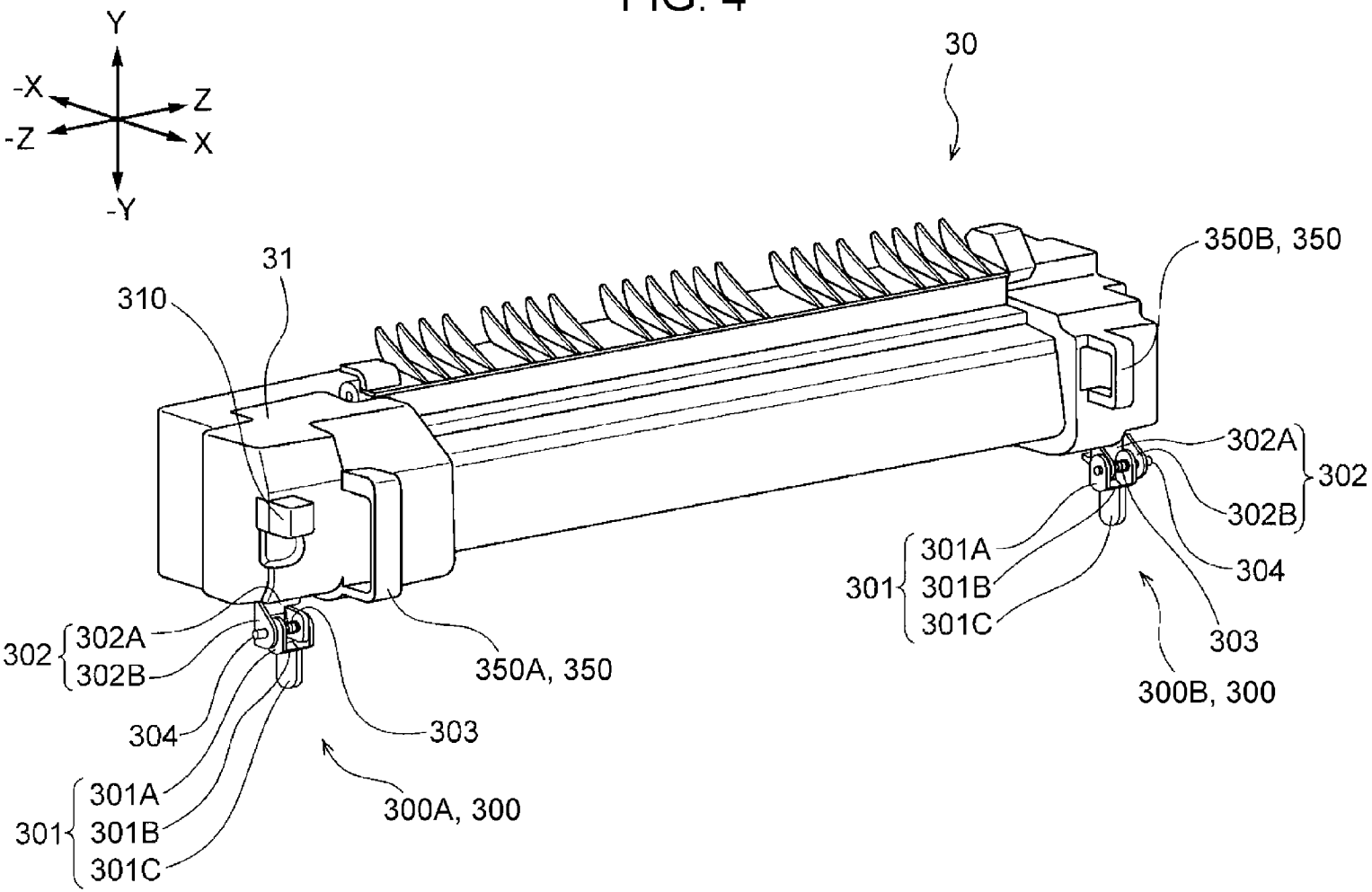
FIG. 4 is an external perspective view of a fixing device according to the present exemplary embodiment.
Figure 5:
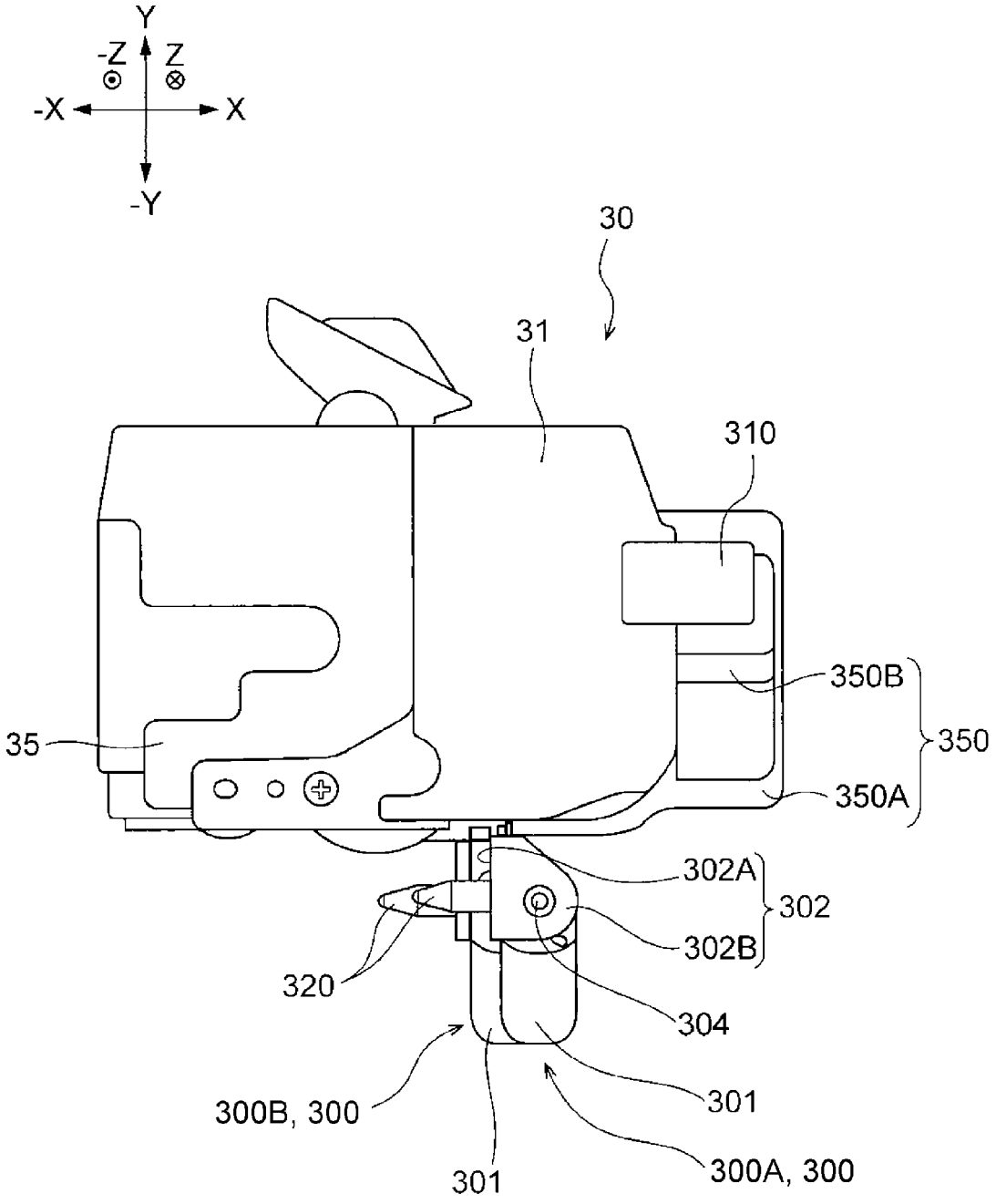
FIG. 5 is a side view of the fixing device according to the present exemplary embodiment.
Figure 6:
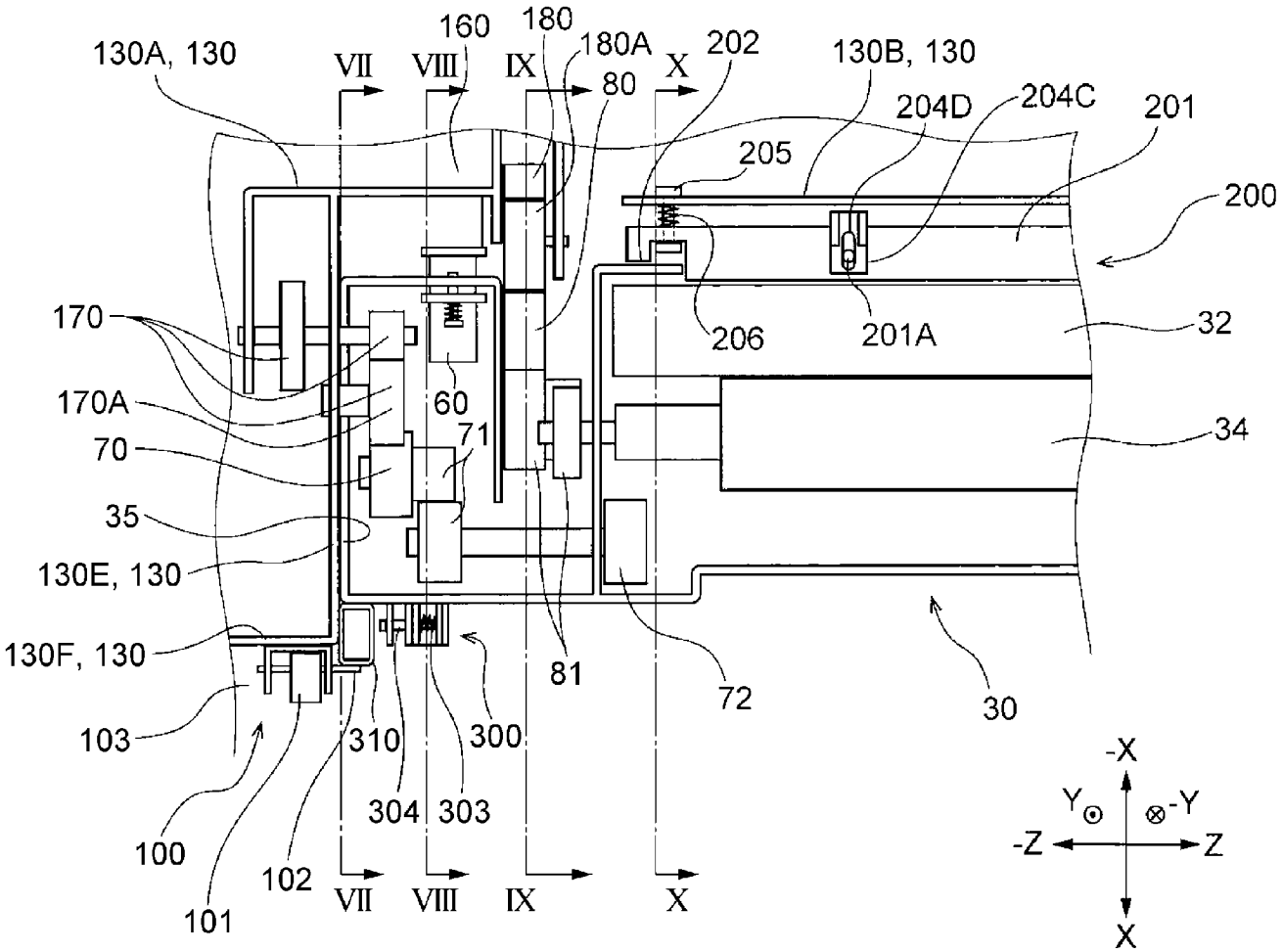
FIG. 6 is a plan view of a part where the fixing device is attached to an apparatus body according to the present exemplary embodiment.
Figure 7:
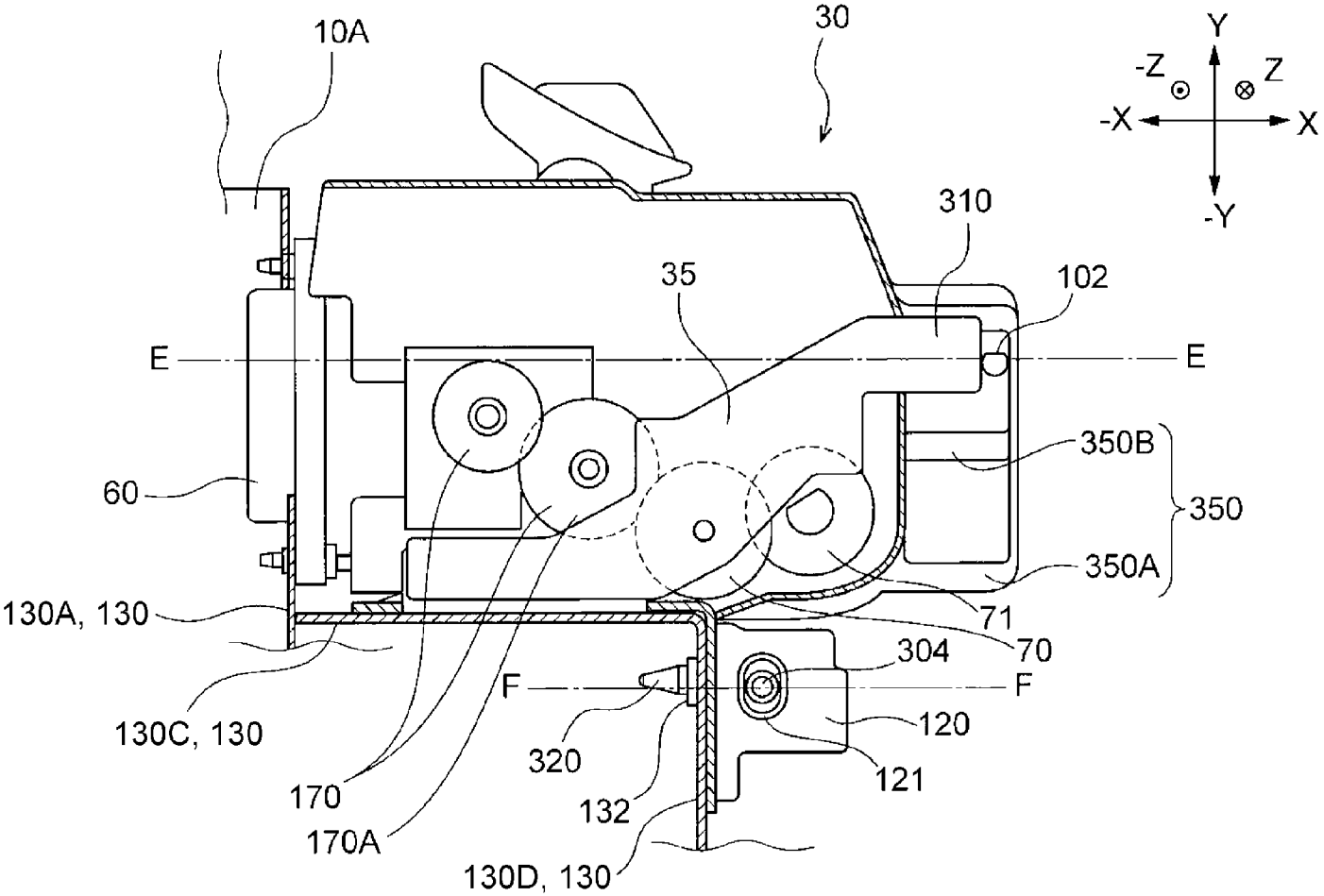
FIG. 7 is a side sectional view (sectional view taken along line VII-VII of FIG. 6) of the part where the fixing device is attached to the apparatus body according to the present exemplary embodiment.
Figure 8:
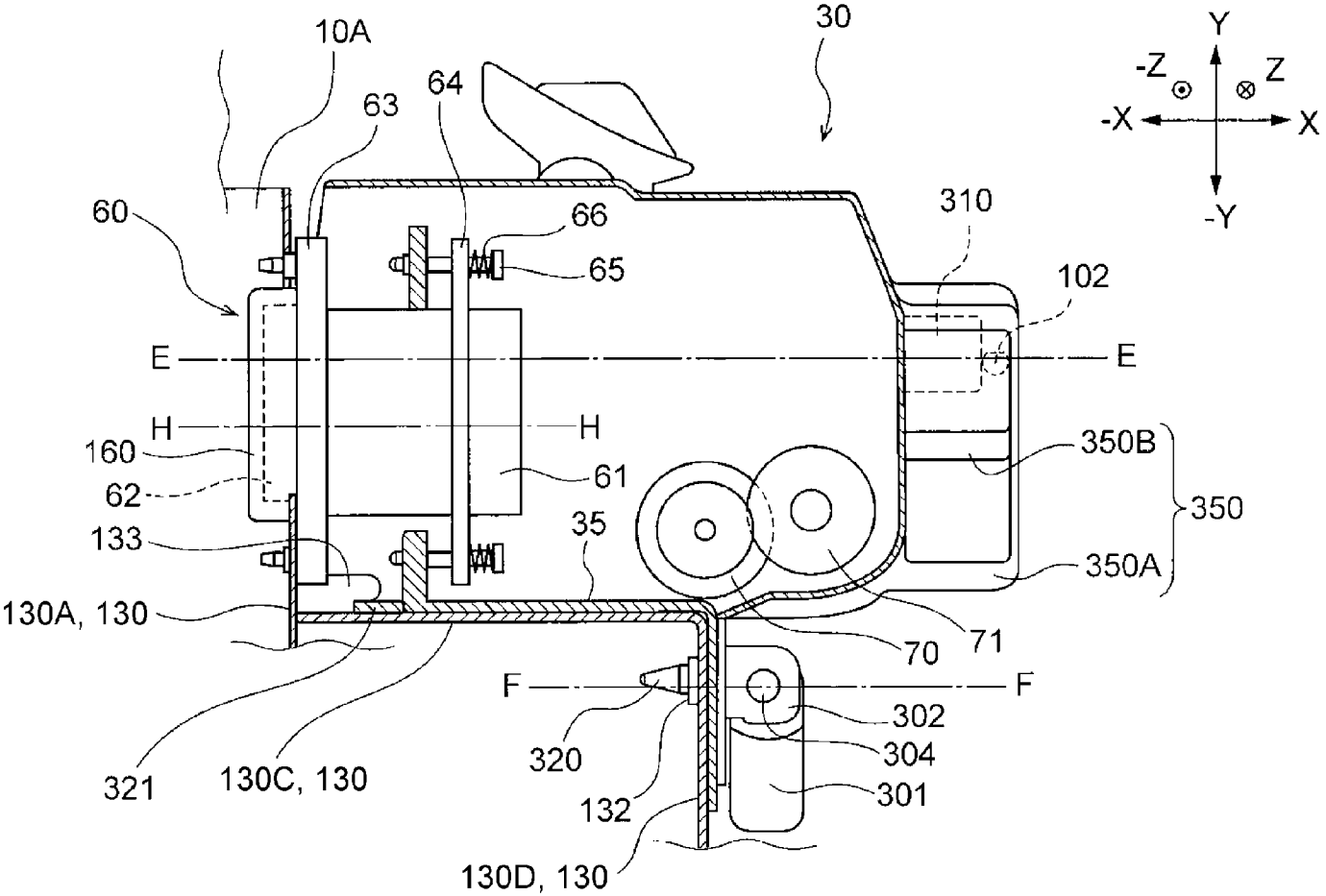
FIG. 8 is a side sectional view (sectional view taken along line VIII-VIII of FIG. 6) of the part where the fixing device is attached to the apparatus body according to the present exemplary embodiment.
Figure 9:
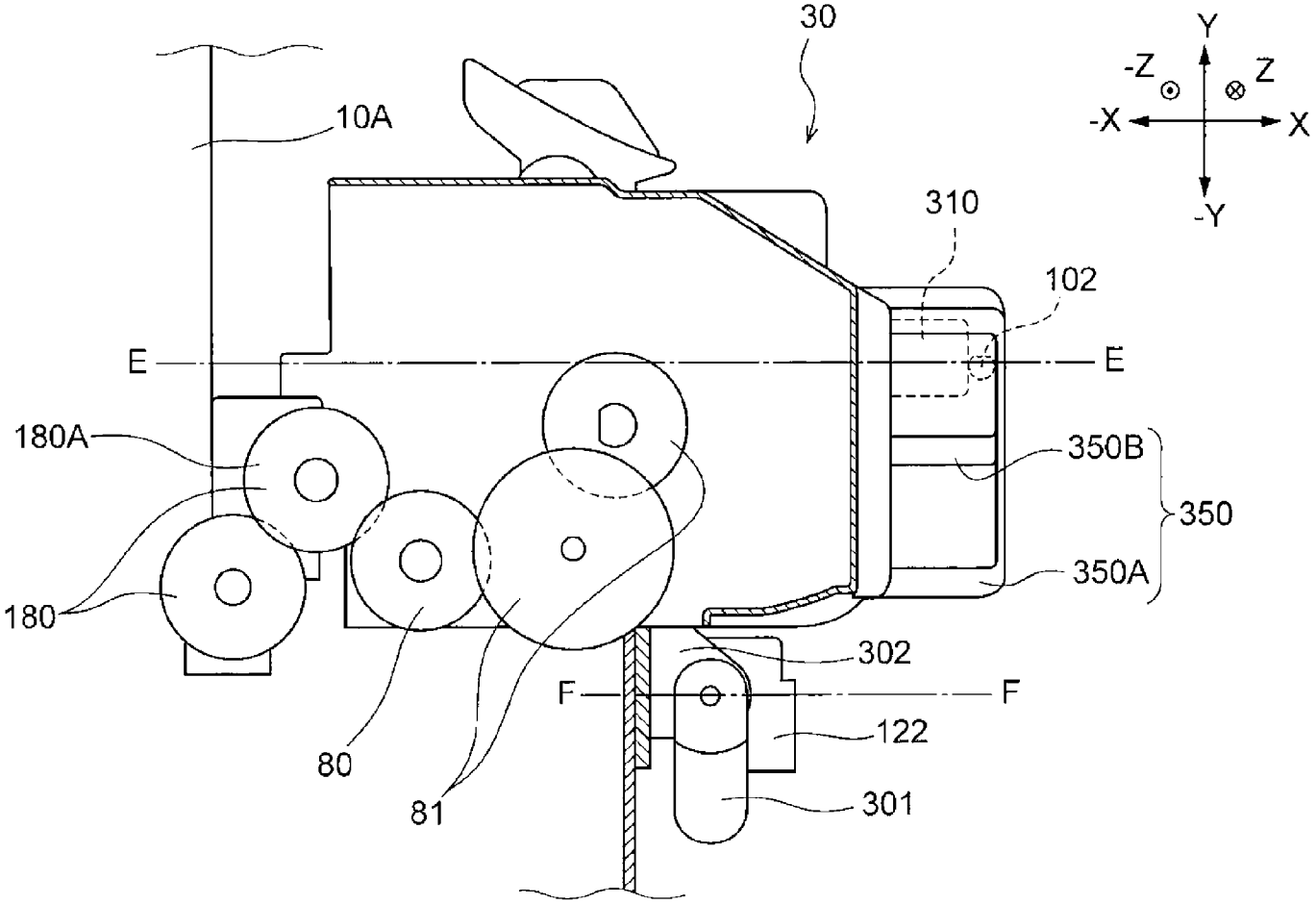
FIG. 9 is a side sectional view (sectional view taken along line IX-IX of FIG. 6) of the part where the fixing device is attached to the apparatus body according to the present exemplary embodiment.
Figure 10:
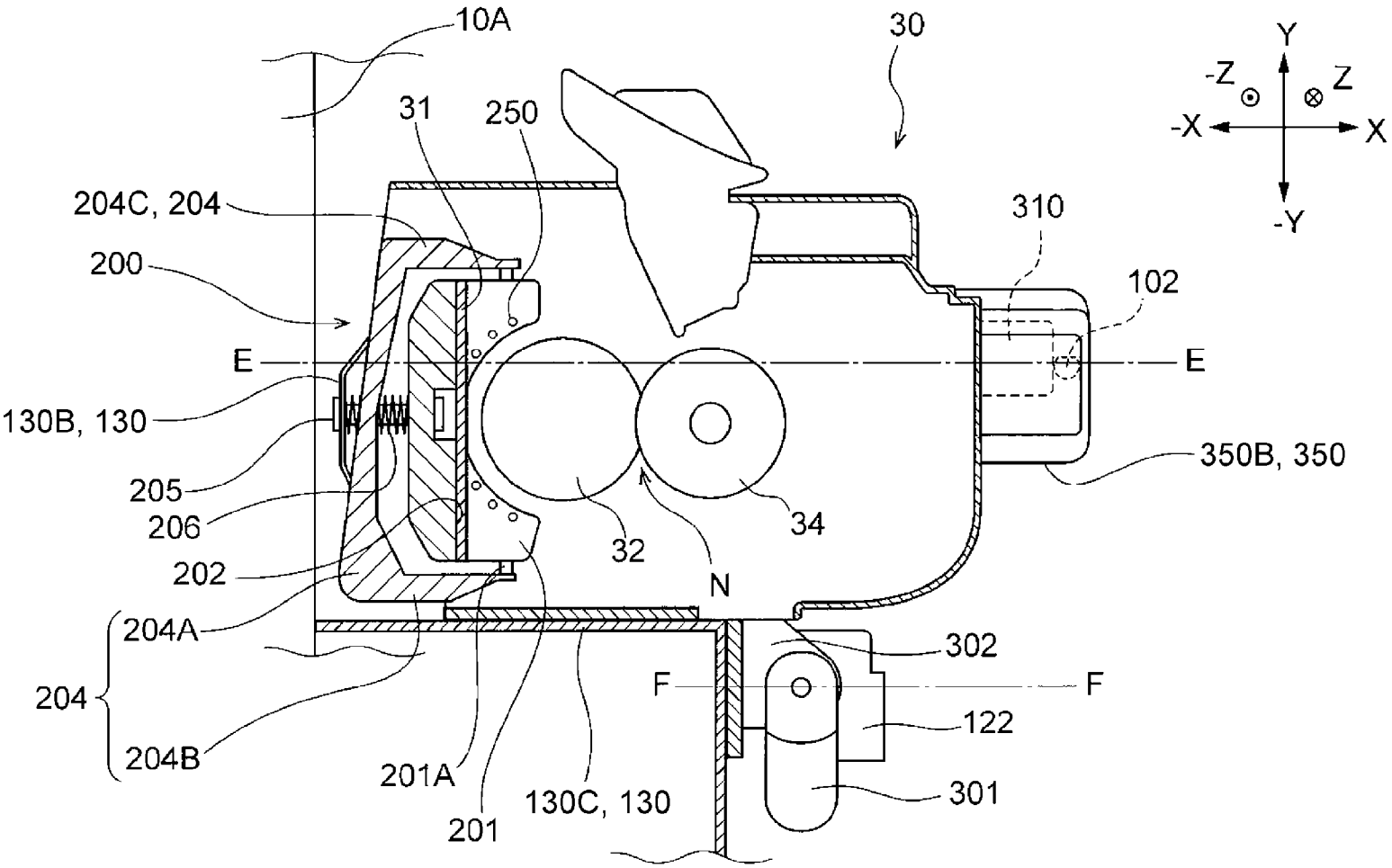
FIG. 10 is a side sectional view (sectional view taken along line X-X of FIG. 6) of the part where the fixing device is attached to the apparatus body according to the present exemplary embodiment.

Next, configurations of parts of an attachment structure according to the present exemplary embodiment are described with reference to the drawings. Here, FIG. 2 is a perspective view of a firmly securing device 100 and a temporarily securing device 300 of the image forming apparatus 10. FIGS. 3A and 3B illustrate operation of the firmly securing device 100, respectively illustrating a released state and a secured state. FIG. 4 is an external perspective view of the fixing device 30. FIG. 5 is a side view of the fixing device 30. FIG. 6 is a plan view of a part where the fixing device 30 is attached to an apparatus body 10A. FIG. 7 is a side sectional view (sectional view taken along line VII-VII of FIG. 6) of the part where the fixing device 30 is attached to the apparatus body 10A. FIG. 8 is a side sectional view (sectional view taken along line VIII-VIII of FIG. 6) of the part where the fixing device 30 is attached to the apparatus body 10A. FIG. 9 is a side sectional view (sectional view taken along line IX-IX of FIG. 6) of the part where the fixing device 30 is attached to the apparatus body 10A. FIG. 10 is a side sectional view (sectional view taken along line X-X of FIG. 6) of the part where the fixing device 30 is attached to the apparatus body 10A.

The Apparatus Body

The part where the fixing device 30 is attached to the apparatus body 10A of the image forming apparatus 10 is described.

As illustrated in FIGS. 2 and 6, the apparatus body 10A according to the present exemplary embodiment includes a frame 130, the firmly securing device 100, and an electromagnetic induction heater 200. The frame 130 is a structural body of the apparatus body 10A. The firmly securing device 100 is provided in the frame 130 and secures the fixing device 30. The electromagnetic induction heater 200 heats a fixing belt 32. The apparatus body 10A also includes a terminal unit 160, a gear train 180, and a gear train 170. The terminal unit 160 electrically connects the apparatus body 10A and the fixing device 30 to each other. The gear train 180 rotates the fixing belt 32 and a pressure roller 34. The gear train 170 is used for adjustment of a pressure state of a nip N.

The Frame

The frame 130 is the structural body of the apparatus body 10A. The frame 130 is formed by combining metal plates. The fixing device 30 is secured to the frame 130. Furthermore, components for operation of the fixing device 30 are disposed in the apparatus body 10A.

The frame 130 is formed so as to have a step shape on the −Z side of the part where the fixing device 30 is attached. In more detail, a first structural surface 130A, a second structural surface 130B, and a third structural surface 130C are provided. The first and second structural surfaces 130A (Y-Z surface; see FIGS. 7 and 8) and 130B (Y-Z surface; see FIG. 10) face a leading surface (surface on the −X side) of the fixing device 30. The third structural surface 130C (X-Z surface) faces a lower surface (surface on the −Y side; see FIGS. 7 and 8) of the fixing device 30. Furthermore, a fourth structural surface 130D is provided. The fourth structural surface 130D is a surface (Y-Z surface) that extends in the −Y direction from a trailing end (end portion on the X side) of the third structural surface 130C (see FIGS. 2, 7, and 8). Furthermore, as illustrated in FIGS. 2 and 6, a fifth structural surface 130E and a sixth structural surface 130F are provided. The fifth structural surface 130E is a surface (X-Y surface) facing a side surface (surface on the −Z side) of the fixing device 30. The sixth structural surface 130F is a surface (Y-Z surface) that extends from a trailing end (end portion on the X side) of the fifth structural surface 130E toward the −Z side. Although it is not particularly illustrated, structural surfaces included in the frame 130 are also provide at portions facing the leading surface (surface on the −X side) and a side surface (surface on the Z side) of the fixing device 30 on the Z side of the fixing device 30.

A pinching portion 133 that pinches a leading end portion 321 of the fixing device 30 is provided at a leading end (end portion on the −X side) of the third structural surface 130C (see FIG. 8). The leading end portion 321 of the fixing device 30 will be described later. Specifically, the pinching portion 133 is formed by, as illustrated in FIG. 8, folding part of a metal plate of the first structural surface 130A toward the Y side about a fold line extending in the X direction. The pinching portion 133 has a groove formed from an end portion on the X side toward an end portion on the −X side. This groove extends throughout the pinching portion 133 in the Z direction. The leading end portion 321 of a housing 31 of the fixing device 30 is inserted into the groove, thereby a movement of the fixing device 30 in the Y direction is regulated.

A securing hole 132 through which a projection 320 on the −Z side of the fixing device 30, which will be described later, is inserted is provided on the −Z side of the fourth structural surface 130D (see FIGS. 7 and 8). When the projection 320 is inserted into the securing hole 132, the movement of the fixing device 30 in the Y direction is regulated. Also, another securing hole 132 is provided on a structural surface (Y-Z surface) on the Z side. When another projection 320 of the fixing device 30 on the Z side is inserted into the securing hole 132 on the Z side, the movement of the fixing device 30 in the Y direction is regulated.

Furthermore, as illustrated in FIGS. 2 and 7, a standing portion 120 that stands on the X side is provided at an end portion on the −Z side of the fourth structural surface 130D. The standing portion 120 is a plate-shaped member having an X-Y surface and has a securing hole 121 through which a columnar projection 304 of the temporarily securing device 300, which will be described later, is inserted. The securing hole 121 is an elongated hole elongated in the Y direction. The width of the securing hole 121 in the X direction is substantially equal to an outer diameter of the columnar projection 304. More specifically, the length of the securing hole 121 in the X direction may vary the outer diameter of the columnar projection 304 within a tolerance. Furthermore, the length of the securing hole 121 in the Y direction is about 1.2 to 1.5 times the outer diameter of the columnar projection 304. Furthermore, an inclination 122 is provided so as to extend from an end portion of the standing portion 120 on the X side toward the X side. The inclination 122 is a surface inclined from the standing portion 120 toward the outside (−Z side) of the apparatus body 10A. It is noted that another standing portion 120, another securing hole 121, and another inclination 122 are provided on a structural surface (Y-Z surface) on the Z side. These elements on the Z side and −Z side are systematically arranged.

The Firmly Securing Device

As illustrated in FIG. 2, the firmly securing device 100 for securing the fixing device 30 is provided at a position which is an end portion on the Z side of the sixth structural surface 130F and which corresponds to a substantial center of the fixing device 30 in the Y direction. The firmly securing device 100 includes a support 103, a movable shaft 102, an operating portion 101, and a stopper 104. The support 103 is provided on the sixth structural surface 130F. The movable shaft 102 is supported so as to be movable in the axial direction relative to the support 103. The operating portion 101 is used to move the movable shaft 102. The stopper 104 regulates rotation of the operating portion 101. Here, the movable shaft 102 is an example of a shaft portion.

The support 103 is a plate-shaped member provided on the sixth structural surface 130F. Both ends of the support 103 in the Z direction are bent toward the X side. More particularly, the support 103 includes a securing surface 103A secured to the sixth structural surface 130F and a pair of bent portions 103B which are formed by bending both the ends in the Z direction of the securing surface 103A. The support 103 supports the movable shaft 102 and the operating portion 101.

As illustrated in FIGS. 3A and 3B, the movable shaft 102 is a pin having a D shape in section and inserted into holes provided in the bent portions 103B. The length of the movable shaft 102 is larger than the distance between the pair of bent portions 103B. Accordingly, the movable shaft 102 is movable in the Z direction and projects from the support 103 toward the Z side or is disposed within the support 103. In the support 103 according to the present exemplary embodiment, one of the bent portions 103B on the Z side is positioned at an end portion on the Z side of the sixth structural surface 130F. Accordingly, the movable shaft 102 is able to project from the apparatus body 10A toward the fixing device 30. In the case where the movable shaft 102 projects toward the Z side, an outer circumferential surface of the movable shaft 102 faces a receiving portion 310 of the fixing device 30, which will be described later. The movable shaft 102 is rotatable about the axis.

Here, as illustrated in FIGS. 2, 3A and 3B, the outer circumferential surface of the movable shaft 102 includes a cylindrical surface 102A and a flat surface 102B (an example of a surface) formed by cutting part of the cylindrical surface 102A in the axial direction (Z direction). When the cylindrical surface 102A faces the receiving portion 310, the cylindrical surface 102A is in contact with the receiving portion 310 so as to press the receiving portion 310 in the −X direction. In contrast, when the flat surface 102B faces the receiving portion 310, a gap of 1 mm is formed between the flat surface 102B and the receiving portion 310.

The operating portion 101 causes, when operated by an operator, the movable shaft 102 to move in the Z direction and rotate the movable shaft 102 about the axis in the Z direction. The operating portion 101 has a hole on the Y side thereof. The movable shaft 102 is fitted into this hole. As illustrated in FIG. 3A, when the operating portion 101 is moved upward (toward the Y side; this state is referred to as "released state" hereafter), the flat surface 102B of the movable shaft 102 faces the receiving portion 310. In contrast, as illustrated in FIG. 3B, when the operating portion 101 is moved downward (toward the −Y side; this state is referred to as "secured state" hereafter), the cylindrical surface 102A of the movable shaft 102 faces the receiving portion 310.

The stopper 104 is a plate-shaped projection formed on the surface on the Z side of the operating portion 101. As illustrated in FIG. 3A, in the case where the operating portion 101 is operated so as to be set in the released state, when an end portion on the Y side of the stopper 104 is brought into contact with one of the bent portions 103B, an upward (Y side) operation of the operating portion 101 is regulated. In contrast, as illustrated in FIG. 3B, in the case where the operating portion 101 is operated so as to be set in the secured state, when an end portion on the −Y side of the stopper 104 is brought into contact with the bent portion 103B, a downward (−Y side) operation of the operating portion 101 is regulated.

The Electromagnetic Induction Heater

As illustrated in FIGS. 6 and 10, the electromagnetic induction heater 200 that heats the fixing belt 32 is provided on the second structural surface 130B. The electromagnetic induction heater 200 includes a coil housing 201 and a support 204. The coil housing 201 houses therein an exciting coil 250 that heats the fixing belt 32 through electromagnetic induction. The support 204 supports the coil housing 201 such that the coil housing 201 is movable in the attachment direction (X direction). The electromagnetic induction heater 200 also includes contacts 202, screws 205, and springs 206. The contacts 202 are provided at both ends in the Z direction of the coil housing 201. The screws 205 connect the contacts 202 to the second structural surface 130B. The springs 206 press the coil housing 201 toward the fixing belt 32 side. Here, the electromagnetic induction heater 200 is an example of a pressing member.

As illustrated in FIG. 10, the coil housing 201 houses therein the exciting coil 250 to which an alternating current is applied. The surface on the X side of the coil housing 201 is a cylindrical recess following the shape of the fixing belt 32.

The support 204 supports the coil housing 201 such that the coil housing 201 is movable in the attachment direction (X direction). The support 204 includes a base 204A, a first grip 204B, and a second grip 204C. The base 204A is provided along and screwed to the second structural surface 130B. The first grip 204B stands erect on the X side at an end portion on the −Y side of the base 204A. The second grip 204C stands erect on the X side at an end portion on the Y side of the base 204A. Here, elongated holes 204D elongated in the X direction are provided in the first grip 204B and the second grip 204C. Projections 201A provided at both ends in the Y direction of the coil housing 201 are inserted into these elongated holes 204D. Thus, the coil housing 201 is supported such that the coil housing 201 is fixed in the Y direction and the Z direction while being movable in the X direction that is the attachment direction of the fixing device 30 (see FIG. 6).

The contacts 202 provided at both the ends in the Z direction of the coil housing 201 are projections of the coil housing 201. The surface on the X side of the plate-shaped contacts 202 are in contact with the housing 31 of the fixing device 30.

The screws 205 connect the contacts 202 to the second structural surface 130B. Specifically, the heads of the screws 205 are inserted into holes provided in the contacts 202 and the shafts of the screws 205 are screwed to the second structural surface 130B.

The springs 206 press the coil housing 201 toward the fixing device 30. The springs 206 being coil springs are disposed around the shafts of the screws 205. One end and the other end of each of the springs 206 are respectively in contact with a corresponding one of the contacts 202 and the second structural surface 130B. With this configuration, the other end of the spring 206 is secured to the second structural surface 130B and the one end in contact with the contact 202 presses the contact 202 (coil housing 201) toward the X side.

The Terminal Unit

As illustrated in FIG. 8, the terminal unit 160 is provided in the first structural surface 130A on the −Z side. The terminal unit 160 electrically connects the apparatus body 10A and the fixing device 30 to each other. Specifically, a terminal unit 62 which will be described later is inserted into the terminal unit 160. The details of the terminal will be described later.

The Gear Trains

The gear train 180 for rotation of the fixing belt 32 and the pressure roller 34 is provided in an opening existing between the first structural surface 130A and the second structural surface 130B (see FIG. 9). The gear train 180 is rotated by a drive motor (not illustrated). One of the gears of the gear train 180 engaged with an operating gear 80 on the fixing device 30 side is referred to as a drive gear 180A. The operating gear 80 will be described later.

The gear train 170 used for adjustment of the pressure state of the nip N, which will be described later, is provided on the fifth structural surface 130E (see FIG. 7). The gear train 170 is rotated by an operating motor (not illustrated). One of the gears of the gear train 170 engaged with an input gear 70 on the fixing device 30 side is referred to as an output gear 170A. The input gear 70 will be described later.

The Fixing Device

The fixing device 30 according to the present exemplary embodiment includes the housing 31, the fixing belt 32, the pressure roller 34, and the temporarily securing device 300. The elements included in the fixing device 30 are described in the following.

FIG. 4 is a perspective view of the fixing device 30 seen from the trailing side in the attachment direction (X direction). The fixing device 30 is attached to the apparatus body 10A by being moved from the X side to the −X side and detached from the apparatus body 10A by being moved from the −X side to the X side.

The Housing

As illustrated in FIG. 4, the housing 31 has a box shape the longitudinal direction of which extends in the Z direction. Openings that allow each of the sheets P to pass therethrough are provided on walls (not illustrated) on the Y side and the −Y side of the housing 31.

Two handles 350 with which the fixing device 30 is operated during attachment and detachment of the fixing device 30 are provided on the trailing side (X side) of the housing 31 in the attachment direction (X direction). The handles 350 include a left handle 350A on the −Z side and a right handle 350B on the Z side.

The Temporarily Securing Device

As illustrated in FIG. 4, two temporarily securing devices 300 that secure the fixing device 30 to the apparatus body 10A are provided at both ends on the −Y side of the housing 31. Specifically, the fixing device 30 is secured by the standing portions 120 of the apparatus body 10A and the temporarily securing devices 300. The temporarily securing devices 300 include a left temporarily securing device 300A provided on the −Z side and a right temporarily securing device 300B provided on the Z side. Here, each of the temporarily securing devices 300 and a corresponding one of the standing portions 120 are included in an example of a first regulating device.

The left temporarily securing device 300A is described below with reference to FIG. 4.

The temporarily securing devices 300 each include a support 302, the projection 304, a release portion 301, and a spring 303. The support 302 extends from the housing 31 toward the −Y side. The projection 304 is movably supported by the support 302. The release portion 301 is for moving the projection 304. The spring 303 applies pressure so that the projection 304 projects from the support 302.

The support 302 is a plate-shaped member extended from an end portion on the −Y side of the housing 31 toward the −Y side and formed by bending toward the X side both the ends in the Z direction. Specifically, the support 302 includes an extension 302A and a pair of bent portions 302B. The extension 302A is a portion extended from the end portion on the −Y side of the housing 31 and provided as a Y-Z surface. The pair of bent portions 302B are portions formed by bending both the ends in the Z direction of the extension 302A and provided as X-Y surfaces. The support 302 supports the projection 304, the release portion 301, and the spring 303.

The projection 304 is a columnar pin inserted into holes formed in the bent portions 302B. The length of the projection 304 is larger than the distance between the pair of bent portions 302B. Accordingly, the projection 304 is movable in the Z direction and projects from the support 302 toward the Z side. The projection 304 is insertable into the securing hole 121 provided in the apparatus body 10A.

The release portion 301 moves the projection 304 in the Z direction. The release portion 301 includes a pair of standing surfaces 301A, a base 301B, and an operating surface 301C. The pair of standing surfaces 301A are provided adjacent to the pair of bent portions 302B. The base 301B connects end portions on the −Y side of the pair of standing surfaces 301A to each other. The operating surface 301C extends from the base 301B toward the −Y side and provided as an X-Y surface. The standing surfaces 301A have holes into which the projection 304 is inserted. Here, when observing the left temporarily securing device 300A from the X side, one of the standing surfaces 301A, one of the bent portions 302B, the other standing surface 301A, and the other bent portion 302B are arranged in this order from the Z side toward the −Z side. The end portion on the Z side of the projection 304 is secured to the standing surface 301A and the end portion on the −Z side of the projection 304 projects from the bent portion 302B.

The spring 303 is a coil spring provided between the bent portion 302B on the Z side and the standing surface 301A on the −Z side. The projection 304 as a pin is inserted through the spring 303 in the axial direction (Z direction). With this spring 303, the projection 304 and the release portion 301 are pressed from the Z side toward the −Z side. Accordingly, as illustrated in FIG. 4, while the projection 304 and the release portion 301 are pressed by the spring 303, the end portion on the −Z side of the projection 304 projects from the bent portions 302B on the −Z side. In contrast, when the operating surface 301C is operated so as to be moved toward the Z side against the pressing force of the spring 303, the projection 304 is contained in the support 302.

The structure of the right temporarily securing device 300B is reversed with respect to that of the left temporarily securing device 300A along the Z direction. That is, as illustrated in FIG. 4, while the projection 304 and the release portion 301 are pressed by the spring 303, the end portion on the Z side of the projection 304 projects from the bent portions 302B on the Z side. In contrast, when the operating surface 301C is operated so as to be moved toward the −Z side against the pressing force of the spring 303, the projection 304 is contained in the support 302.

The Receiving Portion

The receiving portion 310 is a box-shaped member provided at a position which is the substantial center of the housing 31 in the Y direction and an end portion on the −Z side of the housing 31. The receiving portion 310 is supported by a metal frame 35 of the housing 31 (see FIG. 7). A side surface on the X side of the receiving portion 310 is able to be brought into contact with the movable shaft 102 of the firmly securing device 100. Here, the firmly securing device 100 and the receiving portion 310 are included in an example of a second regulating device.

The Projection

As illustrated in FIG. 5, the projection 320 is a conical projection projected from the extension 302A of the support 302 toward the −X side and provided in each of the left temporarily securing device 300A and the right temporarily securing device 300B. The projection 320 is fitted into the securing hole 132 provided at a position corresponding to the projection 320 when the fixing device 30 is attached to the apparatus body 10A. When the projection 320 is fitted into the securing hole 132, the movement of the housing 31 (fixing device 30) in the Y direction is regulated. Here, the projection 320 and the securing hole 132 are included in an example of a third regulating device.

The Leading End Portion

As illustrated in FIG. 8, the leading end portion 321 is part of the frame 35 of the housing 31 and a leading end portion of a metal plate projecting toward the −X side. The leading end portion 321 is fitted into the pinching portion 133 provided at a position corresponding to the leading end portion 321 when the fixing device 30 is attached to the apparatus body 10A. When the leading end portion 321 is fitted into the pinching portion 133, the movement of the housing 31 (fixing device 30) in the Y direction is regulated. Here, the leading end portion 321 and the pinching portion 133 are included in the example of the third regulating device.

Wiring Connecting Unit

A wiring connecting unit 60 is used to receive power required for operating the fixing device 30 and transmitting signals from sensors and the like included in the fixing device 30. The wiring connecting unit 60 is movable in the X direction. Here, the wiring connecting unit 60 is an example of a connecting unit.

As illustrated in FIGS. 6 and 8, the wiring connecting unit 60 is a connector having a rectangular parallelepiped shape. The sides of the wiring connecting unit 60 in the X direction and the Y direction are long and the sides of the wiring connecting unit 60 in the Z direction are short. The wiring connecting unit 60 includes a body 61, the terminal unit 62, a leading-side flange 63, and a trailing-side flange 64. The terminal unit 62 is provided at an end portion on the −X side. The leading-side flange 63 is provided at the boundary between the terminal unit 62 and the body 61. The trailing-side flange 64 is provided on the trailing side (X side) of the body 61. The wiring connecting unit 60 also includes securing screws 65 and springs 66. The securing screws 65 secure the trailing-side flange 64 and the frame 35 to each other. The springs 66 press the wiring connecting unit 60 toward the −X side.

A power cable and signal wires for the sensors are connected to the trailing side (X side) of the body 61. These cables and signal wires are electrically connected to terminals (not illustrated) provided in the terminal unit 62.

The terminal unit 62 is a connecting portion for connection to the terminal unit 160 provided on the apparatus body 10A side. The terminal unit 62 is a male connector which is inserted into the terminal unit 160 which is a female connector so as to be connected to the terminal unit 160.

The leading-side flange 63 is provided at the boundary between the terminal unit 62 and the body 61. The leading-side flange 63 projects so as to surround the body 61. The leading-side flange 63 is in contact with the end (end portion on the X side) of the terminal unit 160 when the terminal unit 62 is connected to the terminal unit 160 on the apparatus body 10A side.

The trailing-side flange 64 is provided on the trailing side (X side) of the body 61. The trailing-side flange 64 projects from both ends in the Y direction of the body 61. The trailing-side flange 64 has holes (not illustrated) at both ends thereof in the Y direction. The securing screws 65 are inserted through the respective holes.

The securing screws 65 are inserted through the holes (not illustrated) of the trailing-side flange 64. The ends of the securing screws 65 (end portions on the −X side) are secured to the frame 35.

The securing screws 65 are inserted through the springs 66 in the axial direction (X direction). End portions on the X side of the springs 66 are in contact with the heads of the securing screws 65 and end portions on the −X side of the springs 66 are in contact with a trailing end surface (surface on the X side) of the trailing-side flange 64. That is, the springs 66 press the wiring connecting unit 60 toward the leading side (−X side) in the attachment direction (X direction). When the fixing device 30 is not attached to the apparatus body 10A, the trailing-side flange 64 is in contact with the frame 35 due to the pressing forces of the springs 66. When the terminal unit 62 is connected to the terminal unit 160 of the apparatus body 10A, the terminal unit 160 moves the wiring connecting unit 60 toward the X side against the pressing forces of the springs 66. In other words, the springs 66 press the terminal unit 62 against the terminal unit 160.

The Pressure Roller

The pressure roller 34 is disposed on the opposite side (X side) of a transport path L of the sheet P (see FIG. 1) to the fixing belt 32 side so as to be rotatable about the axis. The axial direction of the pressure roller 34 extends in the Z direction. As an example according to the present exemplary embodiment, the transport direction of the sheet P extends in the Y direction in the fixing device 30, and the width direction perpendicular to the transport direction of the sheet P extends in the Z direction.

Here, as illustrated in FIG. 9, the pressure roller 34 is rotated by motive power of the drive motor (not illustrated) of the apparatus body 10A transmitted via the plural gears. Specifically, the drive force from the drive motor (not illustrated) of the apparatus body 10A is transmitted to the gear train 180, and then to the operating gear 80 of the fixing device 30 from the drive gear 180A on the X side of the gear train 180. The drive force is then transmitted from the operating gear 80 to the pressure roller 34 via a gear train 81, thereby the pressure roller 34 is rotated. Here, the operating gear 80 is included in an example of an input device.

Here, a portion where the sheet P is nipped between an outer circumferential surface of the pressure roller 34 and an outer circumferential surface of the fixing belt 32 and where the toner T on the sheet P is subjected to heat and pressure is referred to as a nip N. As illustrated in FIG. 7, motive power of an operating motor (not illustrated) of the apparatus body 10A is transmitted via the plural gears. This allows the pressure state in the nip N to be adjusted. Specifically, a drive force from the operating motor (not illustrated) of the apparatus body 10A is transmitted to the gear train 170, and then to the input gear 70 of the fixing device 30 from the output gear 170A on the X side of the gear train 170. Then, the drive force is transmitted from the input gear 70 to a cam 72 (see FIG. 6) via a gear train 71. When the cam 72 presses a lever (not illustrated) upward, the pressure roller 34 is separated from the fixing belt 32, thereby a pressure state (nip state) is released. Here, the input gear 70 is included in the example of the input device.

The Fixing Belt

The fixing belt 32 is an endless belt and disposed on the toner image G side (−X side) of the transport path L of the sheet P (see FIG. 1) so as to be rotatable about the axis. The axial direction of the fixing belt 32 extends in the Z direction. Furthermore, the fixing belt 32 is supported without being tensioned so that portions of the fixing belt 32 other than both ends in the width direction and the nip N are not brought into contact with other members. Here, examples of the structure of the fixing belt 32 include, for example, a structure in which a metal heating layer that generates heat due to electromagnetic induction, an elastic layer, and a surface mold release layer are disposed in this order on a base material layer. With this structure, an alternating current magnetic field from the electromagnetic induction heater 200 passes through the metal heating layer in the width direction. This generates eddy currents in the metal heating layer, thereby the metal heating layer is heated. Thus, the fixing belt 32 generates heat.

A gear for a belt (not illustrated) is provided at an end portion on the −Z side of the fixing belt 32. The motive force of the same drive motor (not illustrated) as that used for the pressure roller 34 is transmitted to the gear train 81 via plural gears to rotate the above-described gear for a belt.

As has been described, the fixing belt 32 according to the present exemplary embodiment is heated by the electromagnetic induction heater 200 and heats the sheet P and the toner images G (toner T) formed on the sheet P while being rotated. Thus, the toner images G are fixed onto the sheet P.

The surface temperature of the fixing belt 32 is measured by, for example, a thermo-sensitive element provided for the fixing belt 32 and controlled by a controller. The type of the thermo-sensitive element is not particularly limited. Examples of the thermo-sensitive element include, for example, a thermistor, a temperature sensor, and so forth.

Methods of Attachment and Detachment

Next, a method of attaching the fixing device 30 to the apparatus body 10A according to the present exemplary embodiment is described. First, the operator opens a door (not illustrated) disposed on a side surface (surface on the X side) of the image forming apparatus 10. Thus, the operator faces the apparatus body 10A. Then, the operator performs operations in the following order.

(1) Temporarily Securing of the Fixing Device

First, when the operating portion 101 of the firmly securing device 100 is in the secured state, the operator sets the operating portion 101 in the released state and moves the operating portion 101 toward the −Z side so as to retract the movable shaft 102 toward the −Z side. Thus, the end portion on the Z side of the movable shaft 102 is positioned further to the −Z side than the fifth structural surface 130E. Thus, the fixing device 30 becomes ready to be inserted.

Next, the operator holds two handles 350 of the fixing device 30 and inserts the fixing device 30 toward an attachment part of the apparatus body 10A in the attachment direction (−X side). At this time, the terminal unit 62 of the fixing device 30 is inserted into the terminal unit 160 of the apparatus body 10A. When the terminal unit 160 is brought into contact with the leading-side flange 63, the terminal unit 160 of the apparatus body 10A moves the wiring connecting unit 60 toward the X side against the pressing forces of the springs 66 of the wiring connecting unit 60. Furthermore, when the housing 31 is brought into contact with the contacts 202 of the electromagnetic induction heater 200, the housing 31 moves the coil housing 201 toward the −X side against the pressing forces of the springs 206 of the electromagnetic induction heater 200.

Meanwhile, the projections 304 of the temporarily securing devices 300 on both the ends in the Z direction are each brought into contact with a corresponding one of the inclinations 122 of the apparatus body 10A. When the operator moves the fixing device 30 further toward the −X side, the projections 304 are contained in the supports 302 due to the inclinations 122 against the pressing forces of the springs 303. When the projection 304 reach the securing holes 121, the ends of the projections 304 are inserted into the securing holes 121 due to the pressing forces of the springs 303. This sets the fixing device 30 in a temporarily secured state in which the movement of the fixing device 30 in the X direction is regulated. Furthermore, when the projections 320 of the fixing device 30 are fitted into the securing holes 132 of the apparatus body 10A, the leading end portion 321 of the fixing device 30 is pinched by the pinching portion 133 of the apparatus body 10A. This regulates the movement of the housing 31 (fixing device 30) in the Y direction (see FIG. 8).

As has been described, in order to attach the fixing device 30 to the attachment part of the apparatus body 10A, the operator needs to insert the fixing device 30 into the apparatus body 10A against the pressing forces of the springs 66 of the wiring connecting unit 60, the springs 206 of the electromagnetic induction heater 200, and the springs 303 of the temporarily securing devices 300.

(2) Firmly Securing the Fixing Device

In the temporarily secured state, the operator moves the operating portion 101 of the firmly securing device 100 toward the Z side so as to cause the movable shaft 102 to project toward the Z side. As a result, the projecting portion of the movable shaft 102 faces the receiving portion 310. During this movement of the operating portion 101 toward the Z side, the flat surface 102B of the movable shaft 102 is positioned at the facing portion that faces the receiving portion 310 because of the operating portion 101 being in the released state. That is, since the 1 mm gap exists between the movable shaft 102 and the receiving portion 310 as has been described, the movable shaft 102 is moved toward the Z side without being brought into contact with the receiving portion 310.

Then, the operator sets the operating portion 101 in the secured state. At this time, the cylindrical surface 102A of the movable shaft 102 is pressed against the receiving portion 310. This sets the fixing device 30 in the firmly secured state in which the movement of the fixing device 30 in the X direction and the Y direction is regulated.

Next, a method of detaching the fixing device 30 from the apparatus body 10A according to the present exemplary embodiment is described. As is the case with the attachment, the operator opens the door (not illustrated) of the image forming apparatus 10. Thus, the operator faces the apparatus body 10A. Then, the operator performs detachment in the following order.

(3) Releasing the Securing of the Fixing Device

First, during the firmly secured state, the operator sets the operating portion 101 of the firmly securing device 100 into the released state. As a result, the movable shaft 102 is rotated and the portion of the movable shaft 102 facing the receiving portion 310 transitions from the cylindrical surface 102A to the flat surface 102B. This changes the state from the firmly secured state to the temporally secured state.

Since the operating portion 101 is set in the released state, the 1 mm gap is formed between the movable shaft 102 and the receiving portion 310. Thus, the operator is able to move the operating portion 101 toward the −Z side. Due to the movement of the operating portion 101 toward the −Z side, the end portion on the Z side of the movable shaft 102 is positioned further to the −Z side than the fifth structural surface 130E. Thus, the fixing device 30 becomes ready to be detached.

(4) Detachment of the Fixing Device

Next, during the temporarily secured state, the operator operates the temporarily securing devices 300 so as to release the temporarily secured state in which the fixing device 30 is temporarily secured to the apparatus body 10A. Specifically, the operator operates the release portion 301 on the −Z side to move toward the Z side and the release portion 301 on the Z side to move toward the −Z side, thereby containing the projections 304 received in the securing holes 121 in the supports 302. This allows the fixing device 30 to move in the X direction. Then, the fixing device 30 is detached from the apparatus body 10A.

Fixing Operation

Next, fixing operation of the fixing device 30 according to the present exemplary embodiment is described. In the fixing operation according to the present exemplary embodiment, the controller 20 controls the electromagnetic induction heater 200 to heat the fixing belt 32 and rotate the fixing belt 32. With the fixing device 30 according to the present exemplary embodiment, the cam 72 is controlled so as to set a nipped state in accordance with the type of the sheet P used for the image forming operation. Furthermore, when the image forming apparatus 10 is in a stand-by state, in the event of a paper jam or the like, the cam 72 is controlled so as to set a nip released state. Switching between the nipped state and the nip released state (control of the cam 72) is performed before the transport section 12 transports the sheet P, for example, as follows: a user inputs the type or the like of the sheet P used for the image forming operation to an input unit (not illustrated); and the controller 20 to which data relating to the type or the like of the sheet P is transmitted as a result of the input by the user switches the state between the nipped state and the nip released state. Then, the toner images G are formed by the image forming section 14 and fixed in the nip N onto the sheet P transported by the transport section 12. Thus, the fixing operation is completed.

Operations

Next, operations according to the present exemplary embodiment are described on the basis of a comparative example and arrangement of the firmly securing device 100 and the temporarily securing devices 300.

A Comparative Example

First, thumbscrews are used to secure the fixing device 30 for a related-art image forming apparatus as the comparative example. Specifically, according to the comparative example, the firmly securing device 100 is not provided. The fixing device 30 is secured by screwing the thumbscrews provided at the positions of the temporarily securing devices 300 according to the present exemplary embodiment into the apparatus body 10A.

As has been described, in order to attach the fixing device 30 to the apparatus body 10A, the operator needs to insert the fixing device 30 into the apparatus body 10A against the pressing forces of the springs 66 of the wiring connecting unit 60 and the springs 206 of the electromagnetic induction heater 200. With a method of securing according to the comparative example, after the fixing device 30 has been inserted toward the apparatus body 10A, the operator needs to operate the thumbscrews by one of his or her hands while pressing the fixing device 30 against the apparatus body 10A by the other hand. That is, during the securing work, the operator needs to use both of his or her hands. Furthermore, the operator needs to continue to firmly press the fixing device 30 until the thumbscrews are engaged with the apparatus body 10A. That is, the operator needs to continue to press the fixing device 30 with an unnecessary force.

Arrangement of the Firmly Securing Device and the Temporarily Securing Devices

According to the exemplary embodiment of the invention, the temporarily securing devices 300 that use a pin insertion method instead of the thumbscrews are used, and in addition, the firmly securing device 100 is provided at the one end (on the −Z side) in the Z direction. Here, the arrangement of the firmly securing device 100 and the temporarily securing devices 300 is described.

As illustrated in FIG. 4, the temporarily securing devices 300 are provided at end portions on the −Y side at both the ends of the housing 31 in the Z direction. In contrast, the firmly securing device 100 is provided on the −Z side of the housing 31. This −Z side is a portion where the wiring connecting unit 60, a drive system for the fixing belt 32 and the pressure roller 34 (simply referred to as "drive system" hereafter), and an operating system that switches the nipped state (simply referred to as "operating system" hereafter) are provided. That is, the −Z side where the firmly securing device 100 and the left temporarily securing device 300A are provided is subjected to the pressing forces of the springs and the drive forces of the gears.

As illustrated in FIG. 6, when the part of the fixing device 30 is attached is seen from the top, the input gear 70 that is the input device of the motive power for the operating system from the apparatus body 10A to the fixing device 30 is provided between the firmly securing device 100 and the left temporarily securing device 300A (between line VII-VII and line VIII-VIII) in the Z direction.

Furthermore, as illustrated in FIG. 7, when observing the section taken along line VII-VII, the input gear 70 that is the input device of the motive power for the operating system from the apparatus body 10A to the fixing device 30 is provided between the firmly securing device 100 and the left temporarily securing device 300A (between line E-E and line F-F) in the Y direction. More specifically, a contact position where the input gear 70 on which the motive power acts is in contact with the output gear 170A is disposed closer to the firmly securing device 100 (line E-E) than to the left temporarily securing device 300A (line F-F) in the Y direction.

Furthermore, as illustrated in FIG. 8, when observing the section taken along line VIII-VIII, the springs 66 are provided at both the ends in the Y direction so as to press the wiring connecting unit 60 against the terminal unit 160 of the apparatus body 10A. A resultant force of the pressing forces of the springs 66 at both the ends is produced at a central portion in the Y direction of the wiring connecting unit 60 (in line H-H). Here, the central portion in the Y direction of the wiring connecting unit 60 (in line H-H) where the resultant force of the pressing forces of the springs 66 is produced is provided between the firmly securing device 100 and the left temporarily securing device 300A (between line E-E and line F-F) in the Y direction. More specifically, the central portion in the Y direction of the wiring connecting unit 60 (in line H-H) where the resultant force of the pressing forces of the springs 66 is produced is provided closer to the firmly securing device 100 (line E-E) than to the left temporarily securing device 300A (line F-F) in the Y direction.

Furthermore, as illustrated in FIG. 9, when observing the section taken along line IX-IX, the operating gear 80 that is the input device of the motive power for the driving system from the apparatus body 10A to the fixing device 30 is provided between the firmly securing device 100 and the left temporarily securing device 300A (between line E-E and line F-F) in the Y direction. More specifically, a contact position where the operating gear 80 on which the motive power acts is in contact with the drive gear 180A is disposed closer to the firmly securing device 100 (line E-E) than to the left temporarily securing device 300A (line F-F) in the Y direction.

Furthermore, as illustrated in FIG. 10, when observing the section taken along line X-X, the springs 206 that press the coil housing 201 of the electromagnetic induction heater 200 toward the fixing belt 32 side are provided between the firmly securing device 100 and the left temporarily securing device 300A (between line E-E and line F-F) in the Y direction. More specifically, the springs 206 are provided closer to the firmly securing device 100 (line E-E) than to the left temporarily securing device 300A (line F-F) in the Y direction. The position of the springs 206 in the Y direction is coincident with the position of the central portion in the Y direction of the wiring connecting unit 60 (in line H-H).

Furthermore, the nip N formed by the fixing belt 32 and the pressure roller 34 is provided between the firmly securing device 100 and the left temporarily securing device 300A (between line E-E and line F-F) in the Y direction. More specifically, the nip N is provided closer to the firmly securing device 100 (line E-E) than to the left temporarily securing device 300A (line F-F) in the Y direction.

The Details of the Operations

The detailed operations according to the present exemplary embodiment on the basis of the comparative example and the arrangement of the firmly securing device 100 and the temporarily securing devices 300 described above are as follows.

(1) The Temporarily Securing Devices and the Firmly Securing Device

The wiring connecting unit 60 is provided in the fixing device 30 to receive the power required to operate the fixing device 30 and transmit the signals from the sensors and the like included in the fixing device 30. In order to electrically connect an attachable/detachable unit such as a fixing device 30 according to the present exemplary embodiment, a drawer connector, with which versatility of the angle for terminal connection is obtained, is used. In order to reliably connect the terminals, the springs 66 are provided at both the upper and lower (Y direction) ends of the wiring connecting unit 60 as the drawer connector, thereby the terminal unit 62 on the wiring connecting unit 60 side is pressed against the terminal unit 160 on the apparatus body 10A side. As the pressing forces of the springs 66 increase, the connection between the terminal unit 160 and the terminal unit 62 becomes reliable. This produces, however, a resisting force when the fixing device 30 is inserted into the apparatus body 10A.

In order to address this, the temporarily securing devices 300 and the firmly securing device 100 are provided according to the present exemplary embodiment. That is, when the temporarily securing devices 300 are attached to the apparatus body 10A (in the case of temporary securing), the operator presses the temporarily securing device 300 side against the apparatus body 10A so that the fixing device 30 is slightly inclined toward the temporarily securing device 300 side (the upper end side (Y side) of the fixing device 30 is inclined toward the X side) to attach the temporarily securing devices 300 to the apparatus body 10A. Thus, out of the springs 66 disposed at both the upper and lower (Y direction) ends of the wiring connecting unit 60, the lower (−Y side) spring 66 is compressed due to pressing of the temporarily securing device 300 side. Unlike the temporarily securing device 300 side, in the case of temporary securing, the pressing is small on the firmly securing device 100 side. Thus, the upper (Y side) spring 66 is compressed less than the lower (−Y side) spring 66.

As has been described, according to the present exemplary embodiment, the springs 66 disposed at both the upper and lower (−Y direction) ends of the wiring connecting unit 60 are not simultaneously compressed during the temporary securing. This reduces a compressive force acting when the fixing device 30 is inserted. That is, compared to the case such as a case with the comparative example where an unnecessary force is applied for securing, an operating force may be reduced. Furthermore, according to the present exemplary embodiment, the fixing device 30 is secured only by pressing the fixing device 30 against the apparatus body 10A. Thus, the operator may perform the attachment work only with one of his or her hands.

Furthermore, in the case of the firm securing, the cylindrical surface 102A of the movable shaft 102 is pressed against the receiving portion 310 only by moving the operating portion 101 of the firmly securing device 100 downward. That is, the fixing device 30 is secured against the pressing forces of the springs 66 (the upper (Y side) spring 66 in particular).

(2) Disposition of the Points of Application Between the Firmly Securing Device and the Temporarily Securing Devices As has been described, according to the present exemplary embodiment, the points of application of connecting portions between the fixing device 30 and the apparatus body 10A are positioned between the firmly securing device 100 and the left temporarily securing device 300A (between line E-E and line F-F) in the Y direction. Specifically, these points of application are as listed below.

Point of Application A: the position where the resultant force of the pressing forces of the springs 66 of the wiring connecting unit 60 is produced Points of Application B: the positions where the pressing forces of the springs 206 of the electromagnetic induction heater 200 are produced Point of Application C: the contact position where the input gear 70 that is the input device of the motive force for the operating system is in contact with the output gear 170A Point of Application D: the contact position where the operating gear 80 that is the input device of the motive force for the drive system is in contact with the drive gear 180A.

Here, the fixing device 30 according to the present exemplary embodiment includes the frame 35 formed of metal. When the fixing device 30 is secured only with the temporarily securing devices 300, the upper side (Y side) of the fixing device 30 is moved slightly toward the trailing side (X side) due to flexure of the frame 35. Here, the lower side (−Y side) of the fixing device 30 is secured to the apparatus body 10A. Accordingly, moments that rotate (clockwise in FIGS. 7 to 10) the upper side (Y side) toward the trailing side (X side) are produced in the fixing device 30. This causes the fixing device 30 to be inclined toward the trailing side (X side).

According to the present exemplary embodiment, the firmly securing device 100 and the left temporarily securing device 300A are disposed so that the above-described points of application where the moments that rotate the upper side (Y side) of the fixing device 30 toward the trailing side (X side) are produced are positioned between the firmly securing device 100 and the left temporarily securing device 300A (between line E-E and line F-F). This may prevent the fixing device 30 from being inclined toward the trailing side (X side). Furthermore, in the case where the fixing device 30 is attached to the apparatus body 10A, when the fixing device 30 is not inclined, neither the positional relationship between the axis of the input gear 70 and the axis of the output gear 170A nor the positional relationship between the axis of the operating gear 80 and the axis of the drive gear 180A is necessarily changed. In this case, tooth skipping between the input gear 70 and the output gear 170A and between the operating gear 80 and the drive gear 180A may be prevented.

Furthermore, as has been described, according to the present exemplary embodiment, the point of application C is positioned between the firmly securing device 100 and the left temporarily securing device 300A (between line VII-VII and line VIII-VIII) in the Z direction (see FIG. 6). Here, the temporarily securing devices 300 of the fixing device 30 according to the present exemplary embodiment are secured to the apparatus body 10A, and the point of application C is positioned further to the −Z side than the left temporarily securing device 300A. Accordingly, when the fixing device 30 is secured only with the temporarily securing devices 300, the −Z side of the fixing device 30 is moved slightly toward the trailing side (X side) due to flexure of the frame 35. That is, a moment that rotates (counterclockwise in FIG. 6) the end portion on the left side (−Z side) toward the trailing side (X side) is produced in the fixing device 30. This causes the fixing device 30 to be inclined toward the trailing side (X side).

According to the present exemplary embodiment, the firmly securing device 100 and the left temporarily securing device 300A are disposed so that the point of application C where the moment that rotates the end portion on the left side (−Z side) of the fixing device 30 toward the trailing side (X side) is produced is positioned between the firmly securing device 100 and the left temporarily securing device 300A (between line VII-VII and line VIII-VIII). This may prevent the end portion on the left side (−Z side) of the fixing device 30 from being inclined toward the trailing side (X side). Furthermore, in the case where the fixing device 30 is attached to the apparatus body 10A, when the fixing device 30 is not inclined, the positional relationship between the axis of the input gear 70 and the axis of the output gear 170A is not necessarily changed. In this case, tooth skipping between the input gear 70 and the output gear 170A may be prevented.

In the above description, the arrangement of the firmly securing device 100 and the left temporarily securing device 300A with respect to the points of application has been discussed. However, the fixing device 30 and the apparatus body 10A may be designed so that a resultant force of the forces applied to the points of application (points of application A to D) applied to a position between the firmly securing device 100 and the left temporarily securing device 300A. In this case, however, a force is applied to the point of application C only when the nipped state is switched to the nip released state or the nip released state is switched to the nipped state. Accordingly, the fixing device 30 and the apparatus body 10A may be designed so that a resultant force of the forces applied to the point of application A, the points of application B, and the point of application D is applied to a position between the firmly securing device 100 and the left temporarily securing device 300A.

(3) Disposition of the Points of Application Near a Line Passing Through the Firmly Securing Device As has been described, the temporarily securing devices 300 are secured by inserting the projections 304 into the securing holes 121 provided in the apparatus body 10A. Here, although the width of the securing holes 121 in the X direction is substantially equal to the outer diameter of the projections 304, there is the tolerance. Furthermore, the length of the securing holes 121 in the Y direction is about 1.2 to 1.5 times the outer diameter of the projections 304 (see FIG. 7). Accordingly, when considering deformation of the frame 35, positional accuracy of the temporarily securing devices 300 in the X direction is lower than that of the firmly securing device 100 that is secured by pressing the cylindrical surface 102A of the movable shaft 102.

According to the present exemplary embodiment, when the fixing device 30 is attached to the apparatus body 10A, the positions of the points of application are closer to the firmly securing device 100 (line E-E) than to the left temporarily securing device 300A (line F-F) in the Y direction. Thus, when the fixing device 30 is attached to the apparatus body 10A, displacement of the fixing device 30 in the X direction may be suppressed. In this case, changes in the positional relationship between the axis of the input gear 70 and the axis of the output gear 170A and the positional relationship between the axis of the operating gear 80 and the axis of the drive gear 180A may be suppressed. That is, tooth skipping between the gears that connect the fixing device 30 and the apparatus body 10A may be prevented.

Other than the above-described points of application A to D produced at the connecting portions between the fixing device 30 and the apparatus body 10A, the following point of application exists in the fixing device 30.

Point of Application E: the position where the pressing force of the nip N formed between the fixing belt 32 and the pressure roller 34 is produced.

Although the point of application E does not affect the positioning of the fixing device 30, the point of application E relates to the deformation of the frame 35. According to the present exemplary embodiment, the point of application E is disposed close to the firmly securing device 100 (line E-E). Thus, the firmly securing device 100 may suppress the deformation of the frame 35. In this case, displacement of the fixing belt 32 and the pressure roller 34 in the X direction may be suppressed.

When the fixing device 30 is attached to the apparatus body 10A, the positions of the points of application may be closer to the firmly securing device 100 (line VII-VII) than to the left temporarily securing device 300A (line VIII-VIII) also in the Z direction. In this case, when the fixing device 30 is attached to the apparatus body 10A, displacement of the fixing device 30 in the X direction may be suppressed.

As has been described, the positions of the points of application are closer to the firmly securing device 100 (line E-E, line VII-VII) than to the left temporarily securing device 300A (line F-F, line VIII-VIII). That is, changes in the positional relationship between the axis of the input gear 70 and the axis of the output gear 170A may be suppressed, changes in the positional relationship between the axis of the operating gear 80 and the axis of the drive gear 180A may be suppressed, and displacement of the fixing belt 32 and the pressure roller 34 in the X direction may be suppressed. As the distance between any one of the points of application and the firmly securing device 100 reduces, the degree of suppression increases. That is, the points of application may be disposed on lines (line E-E, line VII-VII) passing through the firmly securing device 100.

Similarly to the case where the point of application is positioned between the firmly securing device 100 and the left temporarily securing device 300A, the arrangement of the firmly securing device 100 and the left temporarily securing device 300A may be designed so that the resultant force of the forces applied to the points of application (points of application A to D) is applied to a position closer to the firmly securing device 100 (line E-E, line VII-VII) than to the left temporarily securing device 300A (line F-F, line VIII-VIII). Also in this case, a force is applied to the point of application C only when the nipped state is switched to the nip released state or the nip released state is switched to the nipped state. Accordingly, the fixing device 30 and the apparatus body 10A may be designed so that a resultant force of the forces applied to the point of application A, the points of application B, and the point of application D is applied to a position closer to the firmly securing device 100 (line E-E, line VII-VII) than to the left temporarily securing device 300A (line F-F, line VIII-VIII).

(4) The Third Regulating Device

According to the exemplary embodiment of the invention, the example of the third regulating device that regulates the fixing device 30 in the vertical direction (Y direction) includes the projections 320, the securing holes 132, the leading end portion 321, and the pinching portion 133. When the projections 320 of the fixing device 30 are inserted into the securing holes 132 of the apparatus body 10A and the leading end portion 321 of the fixing device 30 is pinched by the pinching portion 133 of the apparatus body 10A, the movement of the fixing device 30 in the Y direction is regulated. In addition, the movement in the X direction is regulated by the temporarily securing devices 300 and the firmly securing device 100. Thus, according to the present exemplary embodiment, the position of the fixing device 30 relative to the apparatus body 10A is determined. It is noted that, according to the present exemplary embodiment, no external force acts in the Z direction. Accordingly, the degree of accuracy required in the X direction and the Y direction is not necessarily required for positional accuracy in the Z direction.

(5) The Flat Surface and the Cylindrical Surface of the Movable Shaft of the Firmly Securing Device According to the present exemplary embodiment, the movable shaft 102 of the firmly securing device 100 has the cylindrical surface 102A and the flat surface 102B. The movable shaft 102 is moved in the axial direction (Z direction). More specifically, the movable shaft 102 is able to project from or retract into the support 103. In the case where the operating portion 101 is operated so as to be set in the secured state, the cylindrical surface 102A is brought into contact with the receiving portion 310. In the case where the operating portion 101 is operated so as to be set in the released state, the gap is formed between the flat surface 102B and the receiving portion 310.

According to the present exemplary embodiment, in the case where the fixing device 30 is temporarily secured to the apparatus body 10A, the flat surface 102B and the fixing device 30 (receiving portion 310) are not in contact with each other. Thus, the movable shaft 102 is able to be operated so as to move in the axial direction (Z direction) for the securing by using the firmly securing device 100. Here, in order for the operator to move the movable shaft 102 in the axial direction (Z direction), such a large operating force that is required when pressing the fixing device 30 against the apparatus body 10A is not required. Furthermore, in order to press the cylindrical surface 102A against the receiving portion 310, it is sufficient to operate the operating portion 101 so as to be set in the secured state. Accordingly, such a large operating force that is required when pressing the fixing device 30 against the apparatus body 10A is not required. It is noted that, as the length of the operating portion 101 increases, the operating force for the firm securing of the fixing device 30 reduces. Also, as the outer diameter of the movable shaft 102 increases, the pressing force with which the fixing device 30 is pressed using the firmly securing device 100 during the firm securing increases.

As has been described, the operator may perform the firm securing with one of his or her hands.

Supplemental Remarks

Although the firmly securing device 100 is provided only on one side in the longitudinal direction (Z direction) of the fixing device 30 according to the present exemplary embodiment, this is not limiting. The firmly securing device 100 may be provided on each side in the longitudinal direction of the fixing device 30. Furthermore, although the projecting directions of the projections 304 of the temporarily securing devices 300 and the movable shaft 102 of the firmly securing device 100 extend in the Z direction according to the present exemplary embodiment, this is not limiting. For example, the projections 304 and the movable shaft 102 may project in the Y direction as long as the fixing device 30 is able to be secured to the apparatus body 10A.

Although the firmly securing device 100 and the standing portions 120 are provided in the apparatus body 10A and the corresponding receiving portion 310 and the temporarily securing devices 300 are provided in the fixing device 30 according to the present exemplary embodiment, this is not limiting. For example, in some cases, the firmly securing device 100 and the temporarily securing devices 300 are provided in the apparatus body 10A and the corresponding receiving portion 310 and the standing portions 120 are provided in the fixing device 30. Alternatively, for example, in some cases, the receiving portion 310 and the standing portions 120 are provided in the apparatus body 10A and the corresponding firmly securing device 100 and the temporarily securing devices 300 are provided in the fixing device 30. Alternatively, for example, in some case, the temporarily securing devices 300 and the receiving portion 310 are provided in the apparatus body 10A and the corresponding standing portions 120 and the firmly securing device 100 are provided in the fixing device 30.

Although the movable shaft 102 according to the present exemplary embodiment has the flat surface 102B, this is not limiting. The movable shaft 102 may have a curved surface or an uneven surface instead of the flat surface 102B as long as the movable shaft 102 is able to be operated in the axial direction (Z direction). Furthermore, although the movable shaft 102 according to the present exemplary embodiment is a pin having a D shape in section, this is not limiting. The movable shaft 102 may instead be a cam in which the distance between the axis to an outer circumferential surface varies.

The exemplary embodiment of the invention is applicable not only to the fixing device 30 but also to a unit which is attached to the apparatus body 10A and positioned by using a spring or the like during attachment or which is attached to the apparatus body 10A and receives external motive power while the unit is movable. For example, the exemplary embodiment of the invention is applicable to a developing unit and a photosensitive unit.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An attachment structure for an attachable body, the structure comprising:

an attachable body that is attachable to an apparatus body and that has a leading end and a trailing end in an attachment direction in which the attachable body is attached to the apparatus body;

a connecting unit that is provided on a leading end side of the attachable body in the attachment direction and that is connected to the apparatus body;

a first regulating device that regulates a movement of the attachable body in the attachment direction from a trailing end side; and a second regulating device that is provided at a position closer to the connecting unit than to the first regulating device in a perpendicular direction perpendicular to the attachment direction and that regulates the movement of the attachable body.

2. The attachment structure for an attachable body according to claim 1, the structure further comprising:

a third regulating device that is provided on a first regulating device side of the attachable body in the perpendicular direction and that regulates the movement of the attachable body in the perpendicular direction.

3. The attachment structure for an attachable body according to claim 1, wherein the second regulating device includes a shaft that is able to project from the apparatus body toward the attachable body, and wherein the shaft includes a surface that is not in contact with the attachable body before rotation, and a cylindrical surface that presses the attachable body after the rotation.

4. The attachment structure for an attachable body according to claim 1, wherein the connecting unit is provided between the first regulating device and the second regulating device in the perpendicular direction.

5. The attachment structure for an attachable body according to claim 1, wherein the connecting unit is provided on a line which extends in the attachment direction and which passes through the second regulating device.

6. An image forming apparatus, comprising:

the attachment structure for an attachable body according to claim 1, wherein the attachable body is a fixing device and the connecting unit electrically connects the apparatus body and the fixing device to each other.

7. The image forming apparatus according to claim 6, wherein the fixing device includes an input device to which motive power for the fixing device is input, and wherein the input device is provided between the first regulating device and the second regulating device in the perpendicular direction.

8. The image forming apparatus according to claim 6, wherein the fixing device includes an input device to which motive power for the fixing device is input, and wherein the input device is provided on a line which extends in the attachment direction and which passes through the second regulating device.

9. The image forming apparatus according to claim 6, further comprising:

a pressing member that presses the fixing device from the apparatus body in an opposite direction to the attachment direction, wherein the fixing device includes an input device to which motive power for the fixing device is input, and wherein a resultant force which is a combination of a reactive force applied by the connecting unit, a pressing force applied by the pressing member, and a reactive force received by the input device acts between the first regulating device and the second regulating device in the perpendicular direction.

* * * * *